United States Patent [19]

Dennis, Jr. et al.

[11] Patent Number: 4,653,999

[45] Date of Patent: Mar. 31, 1987

[54] WIND GUARD FOR LIGHTERS

[76] Inventors: George A. Dennis, Jr., 426 Casino Ave., Cranford, N.J. 07016; Albert Aghabekian, 36-20 168th St., Flushing, N.Y. 11358

[21] Appl. No.: 783,130

[22] Filed: Oct. 2, 1985

[51] Int. Cl.[4] ..... F23Q 25/00

[52] U.S. Cl. ..... 431/146; 431/310; 431/311

[58] Field of Search ..... 431/144, 310, 311, 276, 431/146

[56] References Cited

U.S. PATENT DOCUMENTS

| | | | |
|---|---|---|---|
| 1,800,334 | 4/1931 | Aronson . | |
| 2,352,897 | 7/1944 | Hickman . | |
| 2,494,322 | 1/1950 | Ward . | |
| 2,505,047 | 4/1950 | Horning . | |
| 2,622,421 | 12/1952 | Paige . | |
| 3,122,907 | 3/1964 | Gilberton . | |
| 3,353,376 | 11/1967 | Tuckett . | |
| 3,521,985 | 7/1970 | Chrisman et al. | 431/151 |
| 4,371,331 | 2/1983 | Lee | 431/151 |
| 4,531,906 | 7/1985 | Mizukami | 431/310 |

FOREIGN PATENT DOCUMENTS

| | | | |
|---|---|---|---|
| 946107 | 5/1949 | France | 431/146 |
| 76127 | 11/1917 | Switzerland | 431/146 |
| 87239 | 11/1920 | Switzerland | 431/146 |

*Primary Examiner*—Carroll B. Dority, Jr.
*Attorney, Agent, or Firm*—James & Franklin

[57] ABSTRACT

An elongated tubular body is provided into which a lighter is adapted to be received either (a) with its flame-producing parts exposed beyond the tubular body when there is no wind or (b) received within the tubular body when there is wind, the tubular body being provided, for the latter situation, with an opening through which the flame producing mechanism is manually accessible and another opening through which the produced flame is accessible.

5 Claims, 5 Drawing Figures

WIND GUARD FOR LIGHTERS

This invention relates to a lighter guard designed to protect the flame when wind is present and leave the flame unprotected when wind is absent.

The problem of lighting a cigarette or other smoker's item in the wind is ever-present. Means are known which can protect the lighter flame from wind, but such known protective means have various drawbacks which have limited their utility. In most instances they add significantly to the bulk and cost of the lighter. Most give a reasonable degree of protection in light winds but fail in strong winds. Most interfere with access to the flame when no protection from wind is needed. Most become a permanent part of the lighter and detract from its appearance.

We have devised a wind guard for a lighter which avoids the disadvantages of the prior art structures. Under normal (no wind) conditions the lighter is used in its normal fashion, but even in the presence of severe wind conditions our device enables the user to light his smoke with reliability and ease. Our wind guard may be manufactured simply and at very low cost, it optionally becomes a part of the lighter proper which adds to rather than detracts from its appearance, and it does not add appreciably to the bulk of the lighter. One important aspect of our wind guard is that it may be made and purchased separately from a lighter, thus making it an exceptionally attractive item for sale as a premium or novelty, which may be associated with a pre-existing lighter in a very simple and reliable manner.

It is therefore the prime object of the present invention to provide a wind guard for a lighter which is simple and inexpensive yet exceptionally effective in protecting the lighter flame against wind.

It is another object of the present invention to provide a lighter wind guard in the form of a simple structure which can be sold and distributed as such, independently of the lighter with which it is to be used, and which can be associated with that lighter in a simple and reliable manner.

It is yet another object of the present invention to provide a lighter wind guard which can be associated with a lighter in two modes, in one of which the lighter mechanism and flame are exposed in normal fashion and in the other of which the flame is received within the guard so as to be protected from the wind and the lighter mechanism is exposed for manual manipulation.

Our lighter wind guard comprises an elongated tubular body having a cross-sectional shape corresponding to that of the lighter with which it is to be used and having an open end so that the lighter can be received therewithin. In a first mode, corresponding to the absence of wind, the lighter will be received within that tube with the lighter mechanism and flame location extending from the tube so that the lighter may be manipulated in normal fashion, the tube preferably being frictionally retained on the lighter body. When a wind situation exists the guard is used in its second mode, in which the lighter is inserted into the tube so that the lighter mechanism and flame location are received inside the tube, the tube thus functioning as an exceptionally effective wind guard. A side of the tube is provided with a relatively large opening designed to register with the lighter mechanism and to provide access thereto, so that the user, by inserting his finger through that opening, can actuate the mechanism and produce a flame.

The tube is also provided with a second opening in a side designed to register with the location of the flame, thereby to provide access to the flame by the cigarette or other smoker's item. Heat and fumes from the flame escape through an opening in the exposed end of the tube when the guard is used in its second mode.

To the accomplishment of the above, and to such other objects as may hereinafter appear, the present invention relates to a wind guard for a lighter, and to the combination of a lighter with that wind guard, as described in this specification, in which.

Figure 1:
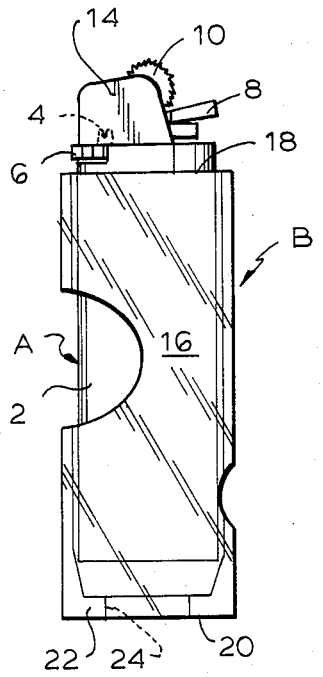
FIG. 1 is a front elevational view of a wind guard of the present invention with a lighter received therein in a no-wind mode.

For purposes of illustration, our wind guard is here disclosed as being designed for use with a well known type of cigarette lighter, generally designated A, which comprises a casing 2 which receives a supply of combustible gas under pressure and which communicates with a nozzle 4 exposed at the upper end of the casing 2, an adjustable wheel 6 being provided to adjust the rate of flow of gas through the nozzle 4 which defines the flame location. A finger piece 8 is adapted to be depressed to open a valve between the casing 2 and the nozzle 4, and thumb wheels 10 are provided which, when rotated, strike a spark from a suitable supply of sparking material. To produce the flame 12, the operator with his thumb 15 in one motion rotates the thumb wheel 10 to produce a spark and depresses the finger piece 8 to cause gas to escape, the spark igniting the gas and thus producing the flame 12. The lighter in question is usually provided with a built-in shield 14 partially surrounding the nozzle 4 for purposes of protection against wind, but that shield 14 is to all intents and purposes ineffectual to protect against anything but the mildest zephyr.

The wind guard of the present invention, generally designated B, comprises an elongated tubular body 16 having a cross-sectional shape and size corresponding to that of the lighter casing 2 so that the lighter casing 2 is snugly receivable therein. It will be understood that the body 16 has the oval cross-sectional shape and size here disclosed in order to match the corresponding external cross-sectional shape of the lighter casing 2 of the particular lighter here selected for the purposes of illustration, and that with specifically different lighters A the cross-sectional shape and size of the tubular body 16 would be correspondingly different. The height of the tubular body 16 may approximate that of the lighter casing 2, and is preferably such that when the lighter A is inserted into the body 16 through its open upper end 18 the operative mechanism of the lighter, and particularly the parts 4, 6, 8 and 10, are all exposed beyond the upper end 18 of the body 16, so that the lighter can then be used in normal fashion. The other end 20 of the body 16 may be partially closed by wall 22 having an opening 24 therethrough, and that wall 22 may be used to limit the degree to which the lighter A slides into the body 16 when the lighter A and guard B have the relative orientation shown in FIG. 1, or, as specifically shown in FIG. 1, the interior of the body 16 may be slightly tapered close to the wall 22, thus permitting the lighter A to be inserted to proper depth and then frictionally held in that inserted position.

With the lighter A and wind guard B associated as shown in FIG. 1, as would be the case under normal no-wind conditions, the body 16 is a fixed part of the lighter assembly. It may be formed of light-transmissive plastic so as not to detract from whatever ornamentation may be provided on the exterior of the lighter casing 2, or the body 16 may carry its own ornamentation, or even a suitable advertising message or logo. Thus it may either act as a protective cover for the ornamentation of the lighter or provide its own esthetic effect. When associated with the lighter A in the mode shown in FIG. 1, it does not interfere at all with the normal functioning and use of the lighter A.

Figure 2:
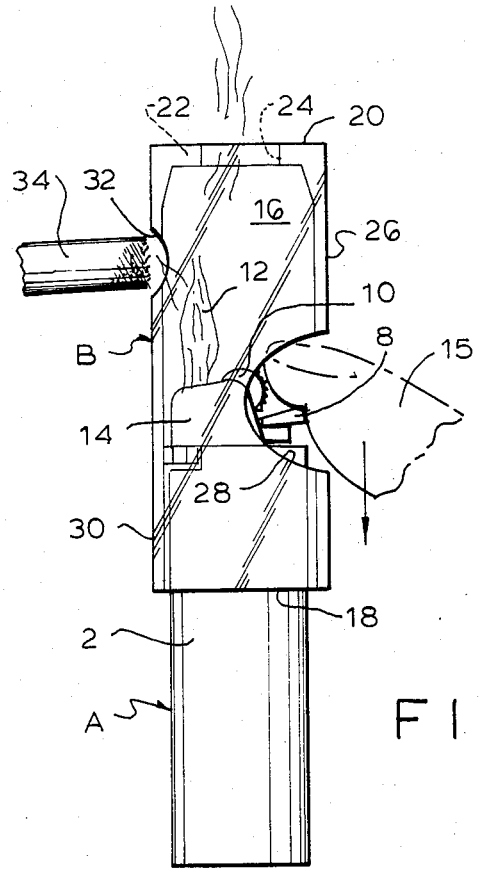
FIG. 2 is a view similar to FIG. 1 but showing the lighter and guard in their respective orientations and location in a wind-protection mode, the figure illustrating manual access to the lighter mechanism and cigarette access to the flame.
Figure 3:
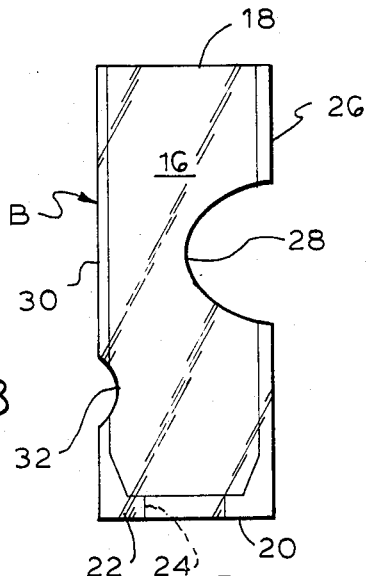
FIG. 3 is a rear elevational view of the wind guard of FIG. 1.
Figure 5:
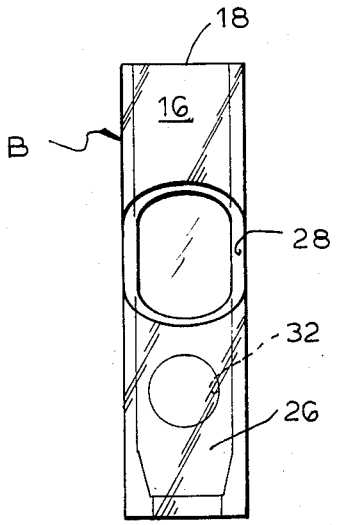
FIG. 5 is a side elevational view thereof, taken from the right-hand side of FIG. 3.
Figure 4:
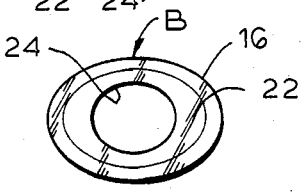
FIG. 4 is a bottom plan view thereof.

When wind conditions are such as to jeopardize the integrity of the flame 12, the wind guard B is pulled off from the lighter A, it is inverted, and it is then pushed down over the ligher A to the position shown in FIG. 2. A side 26 of the body 16 is provided with a relatively large cutout 28 of size sufficient to allow the user's finger 15 to extend therethrough and gain access to the thumb wheels 10 and the valve lever 8, so that the user can manipulate those parts in normal fashion to produce the flame 12. That flame is now within and completely surrounded by the body 16 with the body extending well above the flame and particularly far above the nozzle 4, and thus is very reliably protected against even very strong winds. The heat from the flame 12, as well as combustion gases, are permitted to escape from the interior of the body 16 through the opening 24 in the wall 22, so that the body 16 does not overheat. Such air as may be needed to sustain the flame 12 can enter the body through the opening 28, but the air flow will be such as not to jeopardize the integrity of that flame.

The body 16 is provided, in side 30, with an opening 32 which may be of a size corresponding to the tip of a cigarette or cigar, and when such a smoker's item, such as the cigarette 34 shown in FIG. 2, is brought close to the opening 32, which opening is also opposite a portion, and preferably the upper portion, of the flame 12, the cigarette 34 can be lighted either by inserting the cigarette 34 all the way through the opening 32 or by sufficiently drawing the flame 12 through the opening 32 to ignite the tip of the cigarette if it is held close to but outside the body 16.

After the cigarette has been thus lighted despite the wind, and when the flame 12 has been extinguished, the body 16 may be pulled off from the top of the lighter A and is returned to its association with the lighter A shown in FIG. 1, or may be left in its wind-protection position.

It will be appreciated that the wind guard B is extremely simple to make, and lends itself very well to very inexpensive molding production. It can be merchandised along with the lighter as an appurtenance thereto, or as a separate item to be used with a pre-existing lighter in the possession of the purchaser. Because of this latter aspect, and because it is capable of carrying its own advertising message, it is particularly well adapted to use as a premium or give-away publicity item.

As has been pointed out, our lighter wind guard has been specifically illustrated for use with one type of lighter which is today very widely used, and its size and shape, and the location and size of the openings 28 and 32, correspond to the operative elements of that known lighter. With a different lighter the wind guard would be differently shaped and designed in order to correspond to the shape of that lighter and the location of its operative parts, but it would still conform to the principles outlined above. Other variations could be made in the specific design of the wind guard, all without departing from the spirit of the invention as defined in the following claims.

We claim:

1. In combination with a lighter comprising a casing and, carried on said casing, a flame producing means at a given location adjacent the upper end thereof and actuating means for producing a flame at said flame producing means, said actuating means being exposed at the periphery of said casing for manual access: a wind guard comprising a tubular body shaped to receive said lighter casing, said tubular body being open at one end so as to receive said casing therethrough and having a height generally corresponding to that of said lighter casing, said tubular body having an opening at the other end of allow heat from said flame to escape whereby said casing in one orientation can be received inside said tube with said flame producing means and said actuating means being exposed beyond said tube, and the said casing can be received inside said tube in an inverted orientation of said tube with said flame producing means and said manual actuating means contained within said tube, said tube having a first opening in a side thereof located so as to register with and give access to said actuating means when said casing is received inside said tube in said inverted orientation, and said tube having a second opening in a side thereof axially spaced from said first opening and from the exposed end of said tube so as to register with a point above said flame producing means where the flame would exist when said casing is received inside said tube in said inverted orientation, thereby to provide access to the flame, the remainder of the tube between said second opening and the exposed end of said casing extending beyond said flame producing means, thereby protecting the flame from wind, said first opening being of a size such as to permit the passage therethrough of a finger of the user of the lighter and said second opening being smaller than said first opening and of a size generally corresponding to the tip of a cigarette.

2. The wind guard of claim 1, in which said wind guard has a generally oval cross-section and in which said openings are in the low radius of curvature portions of said oval.

3. The wind guard of claim 1, in which said tubular body is partially closed at its said other end by an end wall having an aperture therethrough sufficiently small so as not to permit the passage of said lighter therethrough.

4. The combination of claim 1, in which said first and second openings are on opposite sides of said tube.

5. The combination of claim 1, in which said tube is formed of a light-transmissive material.

* * * * *